US007357458B2

(12) United States Patent
Hartwig

(10) Patent No.: US 7,357,458 B2
(45) Date of Patent: Apr. 15, 2008

(54) BORING RIG

(75) Inventor: Sverker Hartwig, Täby (SE)

(73) Assignee: Atlas Copco Rock Drills AB, Orebro (SE)

( * ) Notice: Subject to any disclaimer, the term of this patent is extended or adjusted under 35 U.S.C. 154(b) by 33 days.

(21) Appl. No.: 10/573,100

(22) PCT Filed: Nov. 17, 2004

(86) PCT No.: PCT/SE2004/001682

§ 371 (c)(1),
(2), (4) Date: Mar. 23, 2006

(87) PCT Pub. No.: WO2005/049965

PCT Pub. Date: Jun. 2, 2005

(65) Prior Publication Data

US 2007/0035172 A1 Feb. 15, 2007

(30) Foreign Application Priority Data

| | | |
|---|---|---|
| Nov. 21, 2003 | (SE) | 0303100 |
| Jan. 14, 2004 | (SE) | 0400057 |
| Feb. 20, 2004 | (SE) | 0400401 |
| Apr. 16, 2004 | (SE) | 0400986 |

(51) Int. Cl.
*E21C 27/22* (2006.01)
*E21C 29/02* (2006.01)

(52) U.S. Cl. ..... 299/75; 299/11; 299/55; 173/34; 173/190

(58) Field of Classification Search ..... 175/118, 175/230; 299/11, 31, 55, 68, 75; 173/34, 173/190

See application file for complete search history.

(56) References Cited

U.S. PATENT DOCUMENTS

| | | | | |
|---|---|---|---|---|
| 2,176,885 | A * | 10/1939 | Cadwallader | 299/55 |
| 2,726,064 | A | 12/1955 | Goodrich et al. | |
| 2,979,320 | A * | 4/1961 | Adams | 173/34 |
| 3,167,354 | A | 1/1965 | Macaul et al. | |
| 3,647,263 | A * | 3/1972 | Lauber et al. | 299/31 |
| 3,663,054 | A * | 5/1972 | Dubois | 299/18 |
| 3,963,080 | A * | 6/1976 | Walker | 175/94 |

(Continued)

FOREIGN PATENT DOCUMENTS

| | | |
|---|---|---|
| FR | 2461806 | 2/1981 |

(Continued)

*Primary Examiner*—Jennifer H. Gay
*Assistant Examiner*—Shane Bomar
(74) *Attorney, Agent, or Firm*—Mark P. Stone

(57) ABSTRACT

A boring rig (14) for underground boring for excavating purposes and including a substructure (21, 22), a propulsion device, a stabilizing device (31, 32, 35, 36, 37, 38, 39, 42), and a boring unit (20) having a cutter head (29) and a rotation and forcing device (26), in which the rig has a first direction of general travel and two sideways directions, and in which the boring unit (20) is pivotally attached to the substructure for pivotal movement of the boring unit into an operating direction. The stabilizing device includes horizontal (31, 32) and vertical (35, 36, 37, 38, 39) stabilizing elements that are attached to the substructure (21, 22) in order, in active positions, to be pressed against an adjacent rock face so as to transmit forces from the boring unit (20), that are occurring during boring, to the rock face.

15 Claims, 5 Drawing Sheets

U.S. PATENT DOCUMENTS

| | | | | |
|---|---|---|---|---|
| 4,045,088 | A | 8/1977 | Bechem | |
| 5,228,752 | A * | 7/1993 | Hartwig | 299/31 |
| 6,857,706 | B2 * | 2/2005 | Hames et al. | 299/18 |

FOREIGN PATENT DOCUMENTS

| | | |
|---|---|---|
| GB | 800864 | 9/1958 |
| GB | 2005753 | 4/1979 |

* cited by examiner

BORING RIG

FIELD OF THE INVENTION

The present invention concerns a boring rig according to the preamble of the independent claim.

BACKGROUND OF THE INVENTION

There are previously known boring rigs for underground boring, wherein a carrier vehicle at an end position carries a launching device which is pivotal in a plane parallel to a general travel direction of the boring rig with respect to the substructure of the boring rig. A boring unit is extendable from a position inside the launching device axially by means of cutter head rotation and forcing means in order to provide the boring operation.

A boring rig according to the background art is intended and functions well for underground operation, but is time-consuming to set up and its usefulness for production boring is limited in specific applications.

AIM AND MOST IMPORTANT FEATURES OF THE INVENTION

It is an aim of this invention to provide a further development of the boring rig according to the above which is more flexible, allows reduced set-up time and is suitable for production boring in closed locations.

These aims are achieved through the features of the characterizing portion of the independent claim.

Hereby stable set-up may be obtained, fast and effectively so that a boring rig is particularly suitable for extracting ore from ore bearing rock where the ore is present in relatively thin layers extending through said rock.

Such ore is often present in very large shallow cup-shaped formations whereby excavating the ore is carried out in directions relatively close to the horizontal. For that reason the boring unit is pivotal for operation in directions sideways from the travel direction of the boring rig and pivotal in a plane perpendicular to that direction.

Normally it is satisfactory that the boring unit is pivotal over an angle of about 10° below the horizontal to an angle of about 30° above the horizontal.

Having the rotation joints directly attached to the substructure separated along the first direction increases rigidity of the construction.

This is enhanced in that there is a force transmitting means provided between each rotation joint and an adjacent holder for a horizontal jack. Hereby forces occurring during boring are transmitted and resisted in an effective way. This is enhanced in that each holder for a horizontal jack is integral with a stationary part of a respective pivot means.

By the boring unit including a front and a rear frame portion which are separated by linear guide means for guiding bore string rotation and forcing means, an effective, stable and cost effective boring unit is provided.

In particular it is preferred that the boring unit is pivotally attached to the substructure over its rear frame portion because of stability and the possibility of having a compact solution.

By providing the boring unit with sideways stabilizing means at an upper, rear portion for action against a rock phase in directions opposite to the boring direction, the boring rig is further advantageously stabilized during operation.

In a particularly preferred embodiment, a boring rig includes a control unit for controlling setting of the stabilizing means and for controlling boring unit positioning and elevation.

It is further preferred that the control unit is capable of setting the stabilizing means so as to raise or lower and/or tilt the boring rig at predetermined angles with respect to a supporting ground.

This allows for accurate and simple initial positioning of the cutter head before starting the boring operation and to contribute in achieving the accurate boring direction.

Further features and advantages are explained in the following description of an embodiment.

BRIEF DESCRIPTION OF THE DRAWINGS

The method according to the present invention will be described more in detail hereinafter, reference being made to the accompanying drawings, wherein.

DESCRIPTION OF EMBODIMENT

Figure 1:
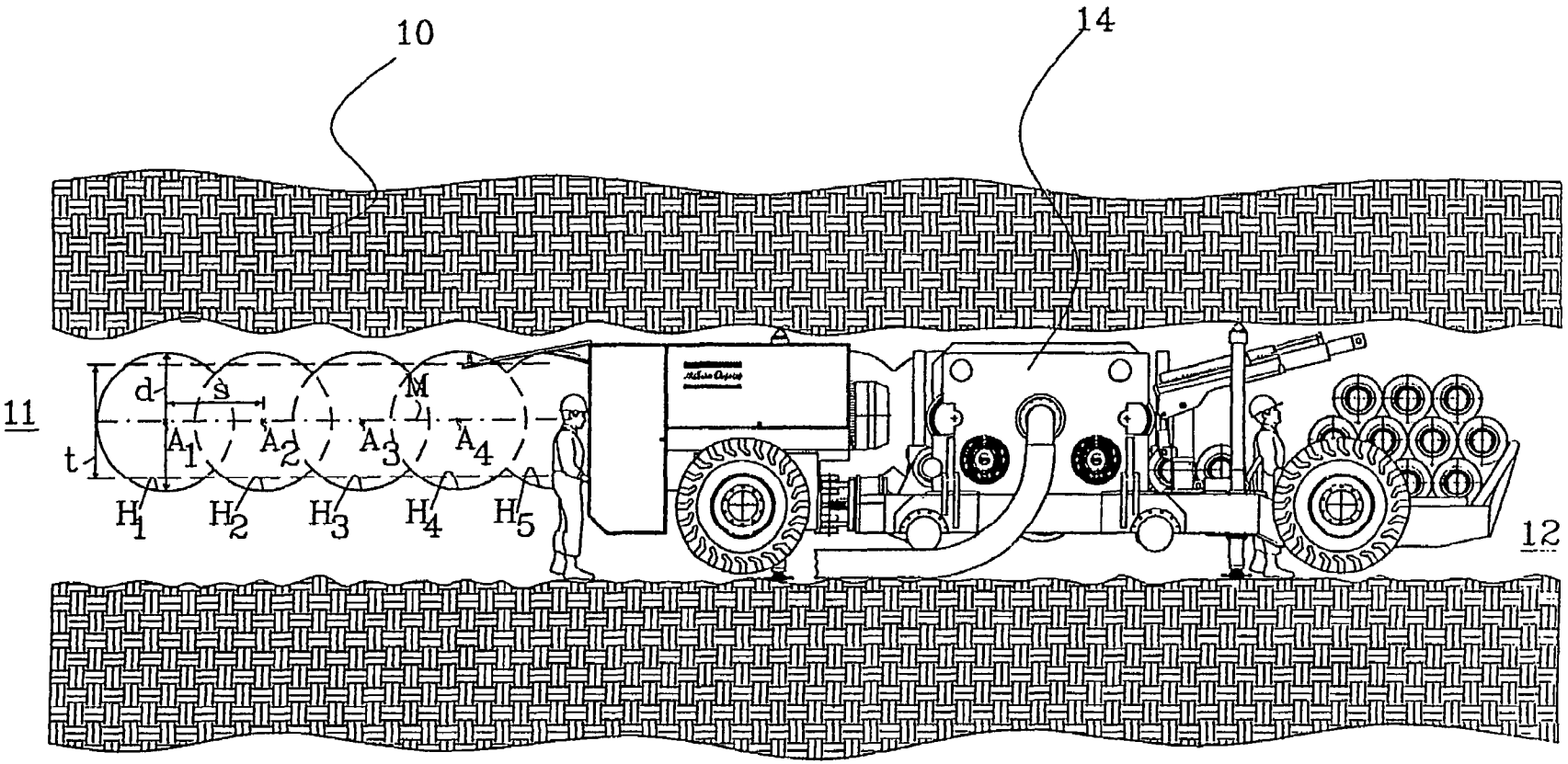
FIG. 1 is a section through a drift extending through a rock and having a drilling machine therein drilling a series of intersecting holes.
Figure 2:
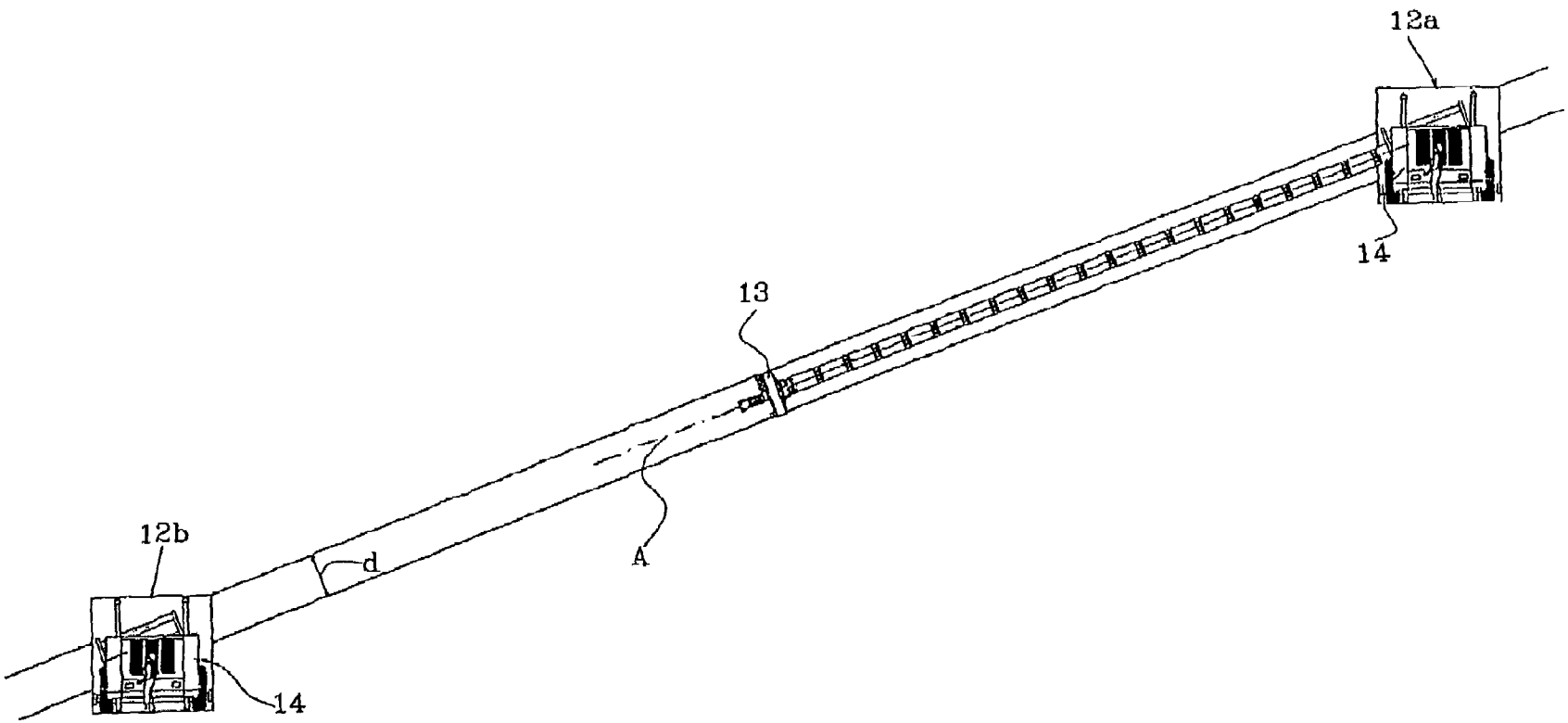
FIG. 2 is a section through a hole drilled between adjacent drifts.
Figure 3:
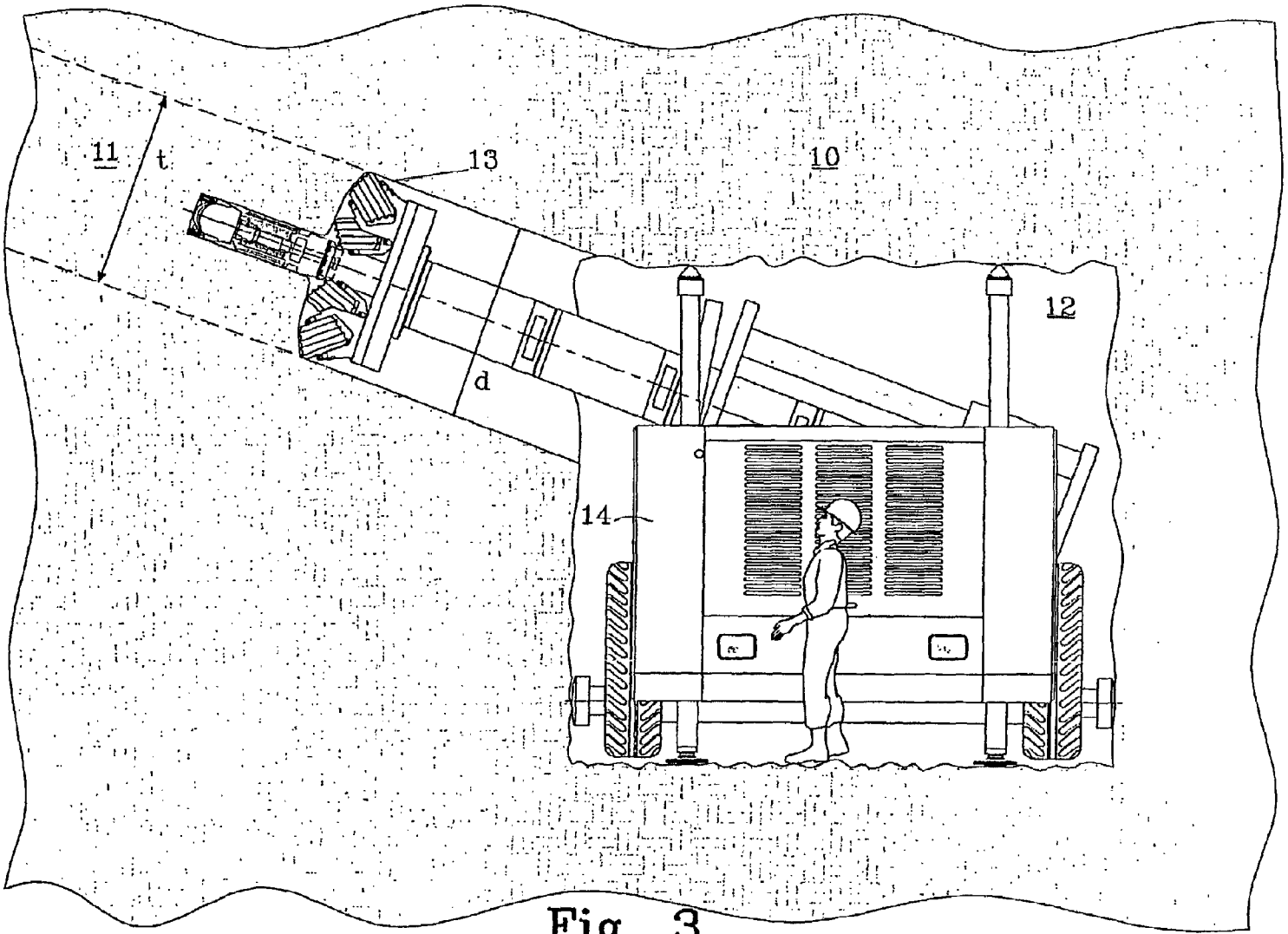
FIG. 3 is a side view of the drilling machine.

A boring rig 14 as shown in FIGS. 1-3 includes various machinery, such as propulsion means, stabilizing means, a boring unit having cutter head rotation and forcing means, a bore string component supply and bore string joining means. The boring rig has a first direction of general travel, (to the right in FIG. 1) and a substructure comprising support body of the boring rig. The operation of the boring rig is controlled by a computerized control unit.

In the FIGS. 1-3, 10 is shown a rock having a relatively thin ore-bearing formation 11 extending therethrough. The extension and approximate thickness of the ore-bearing formation has been determined by drilling from the surface of the ground above the formation. A drift 12 has been made through the rock so as to have the ore-bearing formation 11 extending therealong. The extension (in one direction) and approximate thickness t of the ore-bearing formation determined is indicated in FIGS. 1 and 3 by two spaced dashed lines extending along the drift.

As seen in FIGS. 2 and 3, the ore-bearing formation 11 is shown to be inclined.

A drill 13 having a diameter d substantially corresponding to the approximate thickness t of the ore-bearing layer 11 determined is used to drill a first hole $H_1$ along an axis $A_1$ extending along an approximate mid-plane M of the layer 11 (FIG. 1).

After completion of the first hole $H_1$, a second hole $H_2$ is drilled along a second axis $A_2$ also extending along the approximate mid-plane of the ore-bearing layer 11. The axes $A_1$ and $A_2$ are parallel if the layer is a 'plane' layer, but they may as well be non-parallel if the layer is curved. The spacing s between the axes $A_1$ and $A_2$ is chosen such that the holes $H_1$ and $H_2$ intersect or overlap one another as shown in FIG. 1. In other words, the spacing s is less than the drill diameter d. Evidently, depending on the spacing chosen, more or less material is left unbroken in areas where two holes do not intersect.

The drill cuttings yielded are continuously collected.

In order to achieve acceptable economy of the boring rig 14 in the process of boring the holes $H_1$, $H_2$, $H_3$, $H_4$ and $H_5$, rapid and accurate set-up of the boring rig 14 is essential. This is provided for by the present invention.

Figure 4:
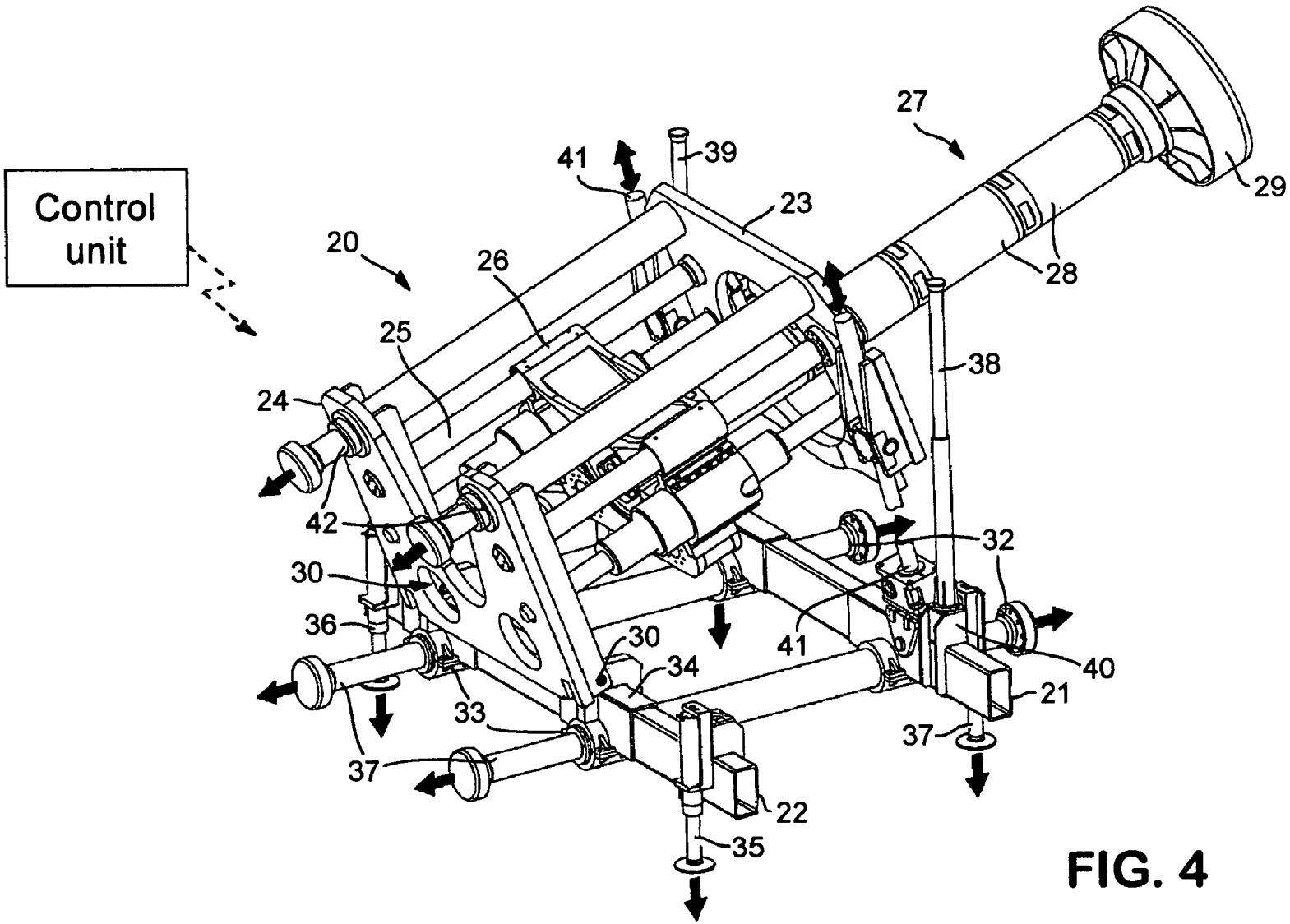
FIG. 4 is a perspective view of a part of a boring rig according to the invention and including a boring unit illustrated in a the process of positioning.

In FIG. 4 a section of a boring rig similar to the one shown in FIGS. 1-3 is shown in detail. In FIG. 4 is thus shown a boring unit 20 which is supported on a substructure of a boring rig, whereof there are shown two longitudinal side members of said rig substructure which are indicated at 21 and 22.

The boring unit 20 is comprised of a front frame portion 23 and a rear frame portion 24 which are separated by separation and strengthening elements formed as linear guide means 25 for a bore string rotation and forcing means which is indicated as an integral unit with numeral 26.

It should be noted that "front" and "rear" concerns front part and rear part respectively of the boring unit 20 and does not concern the front or rear part of the boring rig carrying the boring unit.

A bore string rotation and forcing means 26 is active so as to rotate and press forward a bore string 27, carrying at its distal end a cutter head 29, which is used for obtaining the rock disintegrating/excavating operation.

The bore string 27 consists of a number of axially aligned, connected bore string components 28, which are added to the bore string in a manner which is not part of the invention and therefore not further discussed here.

The boring unit 20 is pivotally connected to the substructure over pivot means 30 in the form of rotation joints between the rear frame portion 24 and a force transmitting means 34 positioned on a side member 22 of the rig substructure. In particular, the rotation joint 30 is positioned at the bottom part of the boring unit and in more in particular at the bottom part of the rear frame portion 24.

Pivotal movement of the boring unit 20 in a plane which is perpendicular to the longitudinal direction of the substructure and in particular of the direction of general travel of the boring rig is obtained through linear actuators 41, one of which being active on each side of the front frame portion 23. In detail each actuator 41 includes a rotator, which may be a hydraulic, pneumatic or electric rotator, which is pivotally attached to a side member 21 and is arranged to rotate a threaded bar, which in turn is engaged with a nut which is pivotally attached to the front frame portion 23. Rotation of the actuators 41 results in altered elevation of the boring unit with respect to the horizontal. It should be noted that the actuators 41 can be comprised of other kinds of linear motors such as for example hydraulic cylinders.

Attached to the rig substructure are a number of stabilizing means which are formed by on the one hand horizontal stabilizing means and on the other hand by vertical stabilizing means.

The horizontal stabilizing means 31 and 32 are comprised of horizontally acting horizontal jacks having engagement ends for engagement with the rock face of the drift, inside which the rig is intended to be positioned in operation. Each horizontal jack 31 is attached to the rig substructure over a holder 33 which in the shown embodiment is integral with the force transmitting means 34, whereby advantageous force transmission is obtained between the cutter head, the boring unit, the substructure and the horizontal stabilizing means.

At the side of the substructure-being opposite to the side of the rotation joints, each corresponding holder for a horizontal jack 32 is attached to a side member 21 of the rig substructure and may for stability reasons be directly or indirectly connected to a holder for the actuator 41 for pivoting the boring unit 20.

The vertical stabilizing means include in the shown embodiment four vertical support jacks 35, 36, 37 (the fourth is not shown) which are active against the drift floor, and which may be set so as to lift the boring rig and in particular its propulsive wheels from the drift floor in order to allow accurate positioning in respect of said floor as is mentioned above.

Further more, there are provided vertical roof jacks 38 and 39, which are active to engage against the drift roof. The holder of each vertical roof jack 38, 39 is preferably connected to or may even be integral with the holder for a vertical support jack. In any case there is preferably provided for force transmission over a force transmitting means 40 between a vertical roof jack 38 and adjacent vertical support jack.

In FIG. 4 only two vertical roof jacks are shown but it should be understood that a pair vertical roof jacks also could be provided adjacent the rear frame portion 24 of the boring unit.

For further stabilization during boring there are provided, in the shown embodiment, a pair of sideways stabilizing means in the form of hydraulic jacks 42 which are positioned at the top of the boring unit. They are in particular constructed as having their cylinder tubes forming stabilizing tubes separating the front frame portion and the rear frame portion of the boring unit 20. The sideways stabilizing means are intended to be engaged against a drift wall so as to resist axial forces in the bore string 27 which would otherwise tend to tilt the boring rig during operation.

A computerized control unit controls the different stabilizing means and the actuators for pivoting the boring unit so as to position both the boring rig and the boring unit prior to operation so as to obtain a side elevation angle for boring purposes. The means for positioning and controlling the boring unit therefore can be said to include the means for positioning and stabilizing the boring rig as well as the means acting between a boring rig substructure and the boring unit 20. Also the boring rig propulsion and steering means contribute in positioning and directing the bore string.

The filled simple arrows in FIG. 4 indicate setting directions for the different stabilizing means upon positioning and stabilization. The double arrows indicate movement up and down of the front frame portion upon actuation on the actuators 41 for pivoting the boring unit.

Figure 5:
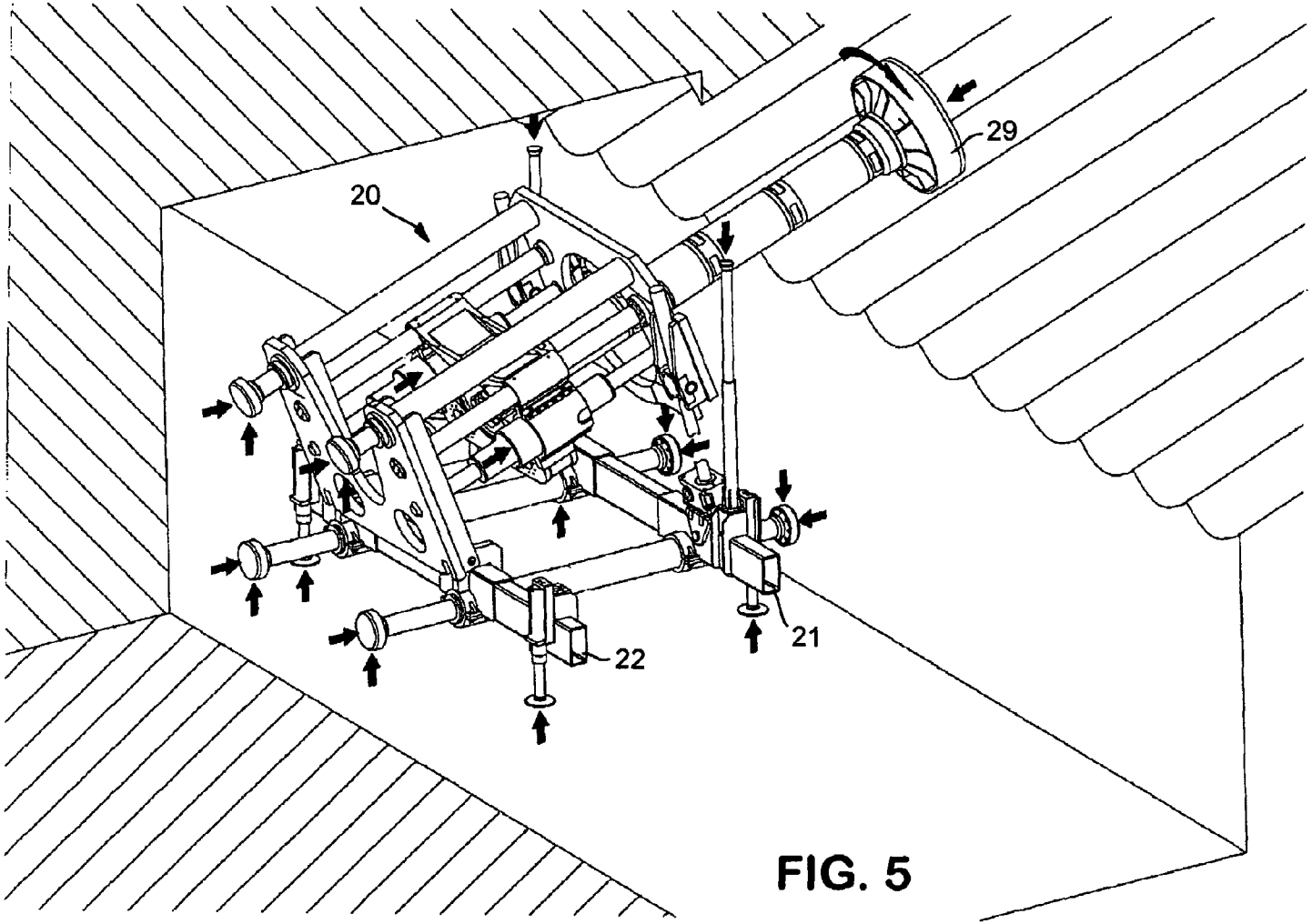
FIG. 5 is a perspective view of the unit of FIG. 4 illustrating forces appearing during boring.

FIG. 5 basically shows the same elements as FIG. 4, but here is also briefly illustrated (by the filled simple arrows) the forces acting on this part of the boring rig. To this end there is indicated that on the cutter head there is acting a torque as well as an axial force because of the rotational and pressing power supplied to the bore string.

On the different jacks making up the stabilizing means there are in principle only axial forces active with respect of the vertical stabilizing means, i.e. the vertical support jacks and the vertical roof jacks, whereas on the horizontal stabilizing means as well as the side ways stabilizing means there are acting axial forces as well as shear forces. The main load resulting from the boring operation is intended to be transmitted over the horizontal stabilizing means, which for that purpose are essentially more powerful than the vertical stabilizing means.

The invention may be modified within the scope of the annexed claims. To that end it should be understood that the different members and elements could be constructed differently from what is shown in the figures.

For example, the substructure could be made up from different elements, such as from plate-shaped elements. The boring unit may be constructed having for example box-like structure instead of the relatively open structure shown in order to separated frames. The jacks may be operated differently, for example as screw jacks instead of hydraulic jacks.

The boring unit may be attached differently to the substructure, for example over a centrally positioned rotation joint instead of a sideways positioned rotation joint as is shown. As an alternative, the boring unit can have the rotation joints attached at its front region so as to allow it to be pivoted around the front portion. This gives greater possibilities of having the elevation angle negative and to excavate in directions obliquely downwards.

The invention claimed is:

1. Boring rig for underground boring for excavation purposes and including a substructure, propulsion means for rig travel along a drift, stabilizing means, and a boring unit having a cutter head and a rotation and forcing means, wherein the rig has a first direction of general travel and two sideways directions, and wherein the boring unit is pivotally attached to the substructure for pivotal movement of the boring unit into an operating direction, wherein the stabilizing means include horizontal and vertical stabilizing means that are directly attached to the substructure in order, in active positions, to be pressed against an adjacent rock face so as to transmit forces from the boring unit, that are occurring during boring, to said rock face; said boring unit being pivotal over pivot means comprising rotation joints attached to the substructure at separate locations along the first direction; said horizontal stabilizing means comprising sideways directed horizontal jacks positioned on each side of said substructure; and force transmitting means provided between each said rotation joint and a holder for one of said horizontal jacks.

2. Boring rig according to claim 1, wherein the boring unit is pivotal for operation in directions essentially perpendicular to the first direction and including one sideways direction.

3. Boring rig according to claim 1, wherein at least one actuator is arranged between the substructure and the boring unit for pivotally moving the boring unit.

4. Boring rig according to claim 1, wherein each holder for a horizontal jack is attached to a respective side member of the substructure.

5. Boring rig according to claim 1, wherein each holder for a horizontal jack is integral with a stationary part of a respective pivot means.

6. Boring rig according to claim 1, wherein the vertical stabilizing means are vertically directed vertical jacks positioned on the substructure.

7. Boring rig according to claim 1, wherein the boring unit is pivotally attached at a bottom portion to the substructure.

8. Boring rig according to claim 1, wherein that the boring unit is pivotally attached at a rear portion to the substructure.

9. Boring rig according to claim 1, wherein the boring unit includes a front and a rear frame portion which are separated by linear guide means for guiding bore string rotation and forcing means.

10. Boring rig according to claim 9, wherein each pivot means are attached to the rear frame portion.

11. Boring rig according to claim 9, wherein each frame portion is comprised of a piece of metal plate.

12. Boring rig according to claim 1, wherein the boring unit at an upper, rear portion is provided with sideways stabilizing means for acting against a rock face in directions which are essentially opposite to the operating direction of the boring unit.

13. Boring rig for underground boring for excavation purposes and including a substructure, propulsion means for rig travel along a drift, stabilizing means, and a boring unit having a cutter head and a rotation and forcing means, wherein the rig has a first direction of general travel and two sideways directions, and wherein the boring unit is pivotally attached to the substructure for pivotal movement of the boring unit into an operating direction, wherein the stabilizing means include horizontal and vertical stabilizing means that are directly attached to the substructure in order, in active positions, to be pressed against an adjacent rock face so as to transmit forces from the boring unit, that are occurring during boring, to said rock face, wherein said boring rig includes a control unit for controlling setting of the stabilizing means and for controlling boring unit positioning and elevation.

14. Boring rig according to claim 13, wherein the control unit is capable of setting the stabilizing means so as to tilt the boring rig at predetermined angles with respect to a supporting ground.

15. Boring rig according to claim 1, wherein said boring rig includes a drill string component supply and drill string joining means.

* * * * *

UNITED STATES PATENT AND TRADEMARK OFFICE

CERTIFICATE OF CORRECTION

PATENT NO. : 7,357,458 B2
APPLICATION NO. : 10/573100
DATED : April 15, 2008
INVENTOR(S) : Sverker Hartwig It is certified that error appears in the above-identified patent and that said Letters Patent is hereby corrected as shown below:

Column 2, Line 43:

Delete "is shown", and

Substitute -- shows --.

Signed and Sealed this

Eighth Day of July, 2008

JON W. DUDAS
*Director of the United States Patent and Trademark Office*